United States Patent [19]

Hannen et al.

[11] Patent Number: 4,958,478

[45] Date of Patent: Sep. 25, 1990

[54] APPARATUS FOR STORING AND SUPPLYING END CLOSURES FOR ENVELOPES OF CYLINDRICAL COMMODITIES

[75] Inventors: Jakob Hannen, Willich, Fed. Rep. of Germany; Jozef-Franc Zajec, Velden, Netherlands; Stephan Piesen, Krefeld, Fed. Rep. of Germany

[73] Assignee: Kleinewefers GmbH, Krefeld, Fed. Rep. of Germany

[21] Appl. No.: 308,548

[22] Filed: Feb. 8, 1989

[30] Foreign Application Priority Data

Feb. 9, 1988 [DE] Fed. Rep. of Germany ..... 3803874

[51] Int. Cl.[5] ..... B65B 11/04

[52] U.S. Cl. ..... 53/415; 53/137; 53/204; 53/504

[58] Field of Search ..... 53/415, 410, 419, 204, 53/203, 137, 139.3, 461, 128

[56] References Cited

U.S. PATENT DOCUMENTS

| | | | |
|---|---|---|---|
| 4,485,612 | 12/1984 | Piesen et al. | 53/504 |
| 4,596,108 | 6/1986 | Piesen et al. | 53/137 |
| 4,633,650 | 1/1987 | Sohlberg et al. | 53/415 |
| 4,744,198 | 5/1988 | Hood et al. | 53/415 |

FOREIGN PATENT DOCUMENTS

| | | |
|---|---|---|
| 1272810 | 7/1968 | Fed. Rep. of Germany . |
| 2944331 | 5/1980 | Fed. Rep. of Germany . |
| 3546284 | 7/1986 | Fed. Rep. of Germany . |

*Primary Examiner*—James F. Coan

*Attorney, Agent, or Firm*—Peter K. Kontler

[57] ABSTRACT

Apparatus for applying disc-shaped end walls to the end faces of rolls of convoluted paper in a positioning unit wherein the rolls are maintained in horizontal positions has a magazine with two rows of floor-mounted pallets for stacks of superimposed end walls having different diameters. A conveyor which is mounted for travel between the two rows of pallets has lifters which can simultaneously pick up end walls from selected pairs of transversely aligned stacks and delivers the thus lifted end walls to an orientation changing unit which moves the end walls from horizontal into vertical planes and centers the end walls prior to applying them to the respective end faces of the roll in the positioning unit.

34 Claims, 7 Drawing Sheets

5
S9
S8
S7
S2
S1
1
2
11
4
6
V2
V1
3
16
13
12
V3
17
21
22
19
18
20
20a

APPARATUS FOR STORING AND SUPPLYING END CLOSURES FOR ENVELOPES OF CYLINDRICAL COMMODITIES

BACKGROUND OF THE INVENTION

The invention relates to apparatus for manipulating flat commodities, particularly for storing and supplying substantially disc-shaped end closures or end walls for envelopes which are used to confine cylindrical objects, such as rolls of convoluted paper webs and the like.

Published German patent application No 29 44 331 of Koutonen et al. discloses a packing machine for rolls of paper or the like. The end walls which are to be applied to end faces of rolls are stored on platforms which are pivotable about the axis of a vertical column between concealed and exposed positions. A pivotable arm carries a tiltable lifter which removes the topmost end wall from the stack on a selected platform while the platform is maintained in the extended position A serious drawback of the proposal of Koutonen et al. is that the magazone can store only a limited supply of end walls and that the magazine is incapable of storing large numbers of different end walls. The reason is that the platforms for storage of different types or sizes of end walls are disposed above each other. If each platform were to store a substantial amount of spare end walls (i.e., if each platform were to carry a tall stack of superimposed end walls, the overall height of the magazine would be increased well beyond acceptable limits and the aforementioned pivotable arm would have to be moved up or down through considerable distances in order to be in a position to pick up an end wall from a platform which is located well above the floor level and to thereupon deliver the end wall to the locus of application to the end face of a roll of convoluted paper or the like.

Commonly owned U.S. Pat. No. 4,596,108 to Piesen et al. discloses a modified apparatus wherein stacks of spare end walls are confined in drawers which are installed on top of each other at both ends of a roll which is to be provided with a pair of end walls. The drawers which contain end walls of desired size are turned about vertical axes to leave the respective magazines and are thereupon pivoted through 90° into vertical planes preparatory to removal of end walls therefrom. This simplifies the task of mechanical applicators which are used to remove end walls from selected drawers and to deliver them to the end faces of the roll at the positioning station between the two magazines. The just described apparatus also exhibits the drawback that its magazines can store limited supplies of spare end walls and that each drawer can store only a relatively short stack of end walls in order to maintain the height of the magazines for superimposed drawers within acceptable limits. Therefore, the supplies of stacked end walls in the drawers of the two magazines must be replenished at frequent intervals, especially if the patented apparatus is used in a production line which turns out and processes large numbers of rolls of convoluted paper webs per unit of time.

Each of the aforedescribed apparatus exhibits the additional drawback that the supplies of spare end walls or like components in the drawers or on the platforms must be replenished by hand. This necessitates continuous presence of attendants. Moreover, the replacement of stacks of superimposed end walls in the upper drawers or on the upper platforms of magazines in the aforedescribed conventional apparatus is a time-consuming and tiresome operation, and uninterrupted availability of stored spare end walls is overly dependent upon the conscientiousness of the person or persons in charge.

Published German patent application No. 35 46 284 of Ekblom discloses an apparatus which constitutes a modification of the apparatus of Koutonen and also employs a magazine wherein a vertical column supports a set of superimposed platforms for relatively small stacks of spare end walls. The apparatus of Ekblom employs an applicator which is pivotable about a horizontal axis in order to transfer the topmost end wall from a selected platform (which has been pivoted to extended position) preparatory to turning of the end wall and the application to the end face of a roll of paper or the like. The drawbacks of the apparatus of Ekblom are identical with those of the apparatus of Koutonen et al.

Commonly owned U.S. Pat. No. 4,485,612 to Piesen et al. discloses a machine for manipulating rolls of convoluted paper or the like. The manipulation involves application of inner and/or outer end walls. The patent does not disclose all details of the means for applying end walls to the rolls. Machines of the type disclosed in this patent can be employed to deliver rolls of convoluted paper webs or the like to and from apparatus of the character disclosed in the aforementioned U.S. Pat. No. 4,596,108 to Piesen et al.

U.S. Pat. No. 4,633,650 to Sohlberg et al. discloses an apparatus for cutting end disks for the packing of paper rolls. The patented apparatus is designed to reduce the sizes of blanks so as to convert the blanks into end disks having a desired diameter The apparatus is equipped with a magazine for four stacks of blanks. A selected stack is lifted in the magazine to the level of a removing conveyor which delivers blanks to the trimming station. The output of the patented apparatus is rather low because the blanks must be trimmed to size preparatory to their application to the end faces of a roll of convoluted paper.

OBJECTS OF THE INVENTION

An object of the invention is to provide an apparatus for the application of end walls or like components to the end faces of cylindrical objects (especially large, heavy and bulky cylindrical objects including rolls of convoluted paper or the like) wherein the replenishment of supplies of components is simpler, more convenient and less time-consuming than in heretofore known apparatus.

Another object of the invention is to provide an apparatus which can store large supplies of components without affecting its output and wherein such large supplies can be replenished by resorting to standard equipment, such as fork lifts and like vehicles.

A further object of the invention is to provide an apparatus the height of which is determined exclusively by the desired height of discrete accumulations of components which are stored therein.

An additional object of the invention is to provide novel and improved depositories for storage of spare components in the above outlined apparatus.

Still another object of the invention is to provide an apparatus the operation of which can be automated much more readily than that of heretofore known apparatus.

A further object of the invention is to provide the apparatus with novel and improved means for manipulating components on their way to the station for the application to cylindrical objects, particularly to the end faces of rolls of convoluted paper webs and the like.

An additional object of the invention is to provide the apparatus with novel and improved means for applying components to cylindrical objects.

Another object of the invention is to provide the apparatus with novel and improved means for centering the components prior to their application to cylindrical objects.

A further object of the invention is to provide a novel and improved method of simplifying the replenishment of supplies of spare components in an apparatus of the above outlined character.

An additional object of the invention is to provide an apparatus which can manipulate, in any desired sequence, any desired practical number of differently dimensioned and/or configurated components and wherein the transition from manipulation of components of a first type to manipulation of components of a different second type or vice versa does not require a stoppage, or even a slowing down, of the apparatus.

Another object of the invention is to provide an apparatus wherein different types of components need not be stored at different levels and wherein the supplies of stored components need not be shifted in their entirety preparatory to or subsequent to removal of discrete components therefrom.

A further object of the invention is to provide the apparatus with simple, compact and inexpensive means for properly positioning cylindrical objects preparatory to and during application of end walls or like components to their end faces.

An additional object of the invention is to provide an apparatus which can simultaneously manipulate and apply plural components with the same degree of accuracy and predictability.

A further object of the invention is to provide an apparatus which exhibits the advantages but does not exhibit the drawbacks of conventional apparatus for the application of inner or outer end walls to the end faces of rolls of convoluted paper or like cylindrical objects.

Another object of the invention is to provide novel and improved conveyor means for transporting components in the above outlined apparatus.

A further object of the invention is to provide an apparatus the operation of which can be automated to any desired extent and which can be incorporated in production lines including calenders and other machines for the making and/or processing of webs of paper, metallic foil, plastic foil or like materials.

SUMMARY OF THE INVENTION

The invention resides in the provision of an apparatus for storing and manipulating different (e.g., differently dimensioned and/or differently configurated) flat components, particularly disc-shaped end walls of envelopes for substantially cylindrical objects (such as rolls of paper and the like) of the type having a peripheral surface and two end faces which flank the peripheral surface. The improved apparatus comprises a battery of depositories for different components, a positioning unit having means for maintaining discrete objects in such positions that the end faces of an object in the positioning unit are accessible for the application of components thereto, transporting means including guide means defining an elongated path extending from the maintaining means along the depositories of the aforementioned battery and conveyor means mounted for movement along the path to transport components from selected depositories of the battery all the way or close to the maintaining means, and means for changing the orientation of components between the maintaining means and the depositories (particularly for centering the components with respect to the end faces of objects in the positioning unit.

The guide means can define a substantially straight path or a path which is arcuate or includes one or more arcuate portions.

Each depository can comprise a pallet or another suitable support for a stack of overlapping components having a particular size and/or shape. It is preferred to select the number of depositories in such a way that their number exceeds the number (m) of different components by n wherein n is a whole number including one.

The depositories of the battery can form two rows which flank the path for the conveying means. Each depository of one row can be located opposite a depository of the other row, and such confronting (transversely aligned) depositories can contain supplies of identical or practically identical components. This renders it possible to simultaneously convey and change the orientation of two identical components, one for each end face of an object in the positioning unit, and to thereupon simultaneously apply the two properly oriented components to the respective end faces of the object in the positioning unit.

The conveyor means of an apparatus wherein the battery includes two rows of components can include means for simultaneously carrying two components including a first component taken from a depository in one of the rows and a second component taken from a depository in the other row.

The guide means can include a first and a second track for the conveyor means, and one of the tracks can be disposed at a level above the other track. The other track can include means for movably supporting the conveyor means and the one track can include means for merely confining the conveyor means for movement along the elongated path.

Alternatively, the guide means can define an overhead track for the conveyor means, i.e., the conveyor means can be suspended on the overhead track for movement along the elongated path.

The conveyor means can comprise at least one pneumatic lifter (e.g., a suction cup) of components and elevator means for moving the at least one lifter up and down. The conveyor means can further comprise at least one arm which serves to advance at a level above the depositories in response to movement of the conveyor means along its path. The lifter or lifters can be provided on the arm so that the lifter or lifters can pick up a component from a selected depository in response to downward movement under the action of the elevator means while the arm is disposed at a level above the selected depository. The arm can be carried by the elevator means for up and down movement with the lifter or lifters.

The conveyor means can comprise a plurality of lifters and means for adjusting at least one of the lifters with reference to the elevator means, particularly for adjusting the level of one or more lifters relative to the elevator means.

The orientation changing means can include a supporting surface for discrete components and stop means adjacent the supporting surface. A component which is supplied to the supporting surface by the conveyor means is movable along or with the supporting surface against the stop means preparatory to movement against one end face of an object in the positioning unit. The maintaining means can comprise two substantially horizontal carriers which serve to contact two spaced-apart portions of the peripheral surface of an object in the positioning unit, and the stop means is preferably arranged to contact two spaced-apart portions of a component on the supporting surface. The mutual spacing of regions of contact between the carriers and an object in the positioning unit can equal or approximate the mutual spacing of regions of contact between the stop means and a component on the supporting surface.

Each carrier of the maintaining means can include an idler roll or another cylindrical member. The stop means can be provided with two convex contact surfaces for the component on the supporting surface. Alternatively, the stop means can include two mutually inclined preferably substantially flat contact surfaces for the component on the supporting surface.

The orientation changing means further includes means for changing the inclination of the supporting surface and of the stop means so that the supporting surface can be moved between a substantially horizontal position for reception of a component from the conveyor means and a substantially vertical position preparatory to application of the component to an end face of the object in the positioning unit. The stop means is preferably located at a level below the supporting surface when the latter is maintained in a substantially vertical position; this renders it possible to cause the component on the supporting surface to descend by gravity onto the stop means for proper orientation prior to application to an end face of the object in the positioning unit. The orientation changing means can comprise at least one conveying device (e.g., a belt conveyor) which defines the supporting surface and is movable in a direction to advance a component on the supporting surface against the stop means. In accordance with a presently preferred embodiment, the orientation changing means comprises a plurality of conveying devices each of which defines a portion of the supporting surface, preferably a supporting surface which can frictionally engage the adjacent side of the component in the orientation changing means.

The orientation changing means further comprises means for applying components to the end faces of objects in the positioning unit. The supporting surface can be provided on such applying means. The stop means can be movably mounted on the applying means so that it can be retracted or recessed into the supporting surface. Alternatively, the applying means can be mounted for movement between a first position for reception of components from the supporting surface and a second position adjacent the object in the positioning unit. Such orientation changing means further comprises means for moving the applying means between the first and second positons. The moving means can comprise a lever which is pivotable about a predetermined axis (preferably an axis which is parallel to the axis of the object in the positioning unit) and serves to move the applying means along an arcuate path between the first and second positions. Such apparatus can further comprise means for changing the level of the predetermined axis for the lever, and means for advancing the lever in substantial parallelism with the axis of the object in the positioning unit.

The applying means preferably further comprises means for driving fasteners into objects in the positioning unit. If the applying means has a substantially circular outline, the fastener driving means is preferably located at or close to the center of such applying means.

The apparatus can further comprise signal generating means for monitoring the diameters of objects in the positioning unit, and means (such as a computer) for operating the conveyor means and the orientation changing means in accordance with a predetermined program in response to signals from the monitoring means.

The novel features which are considered as characteristic of the invention are set forth in particular in the appended claims The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
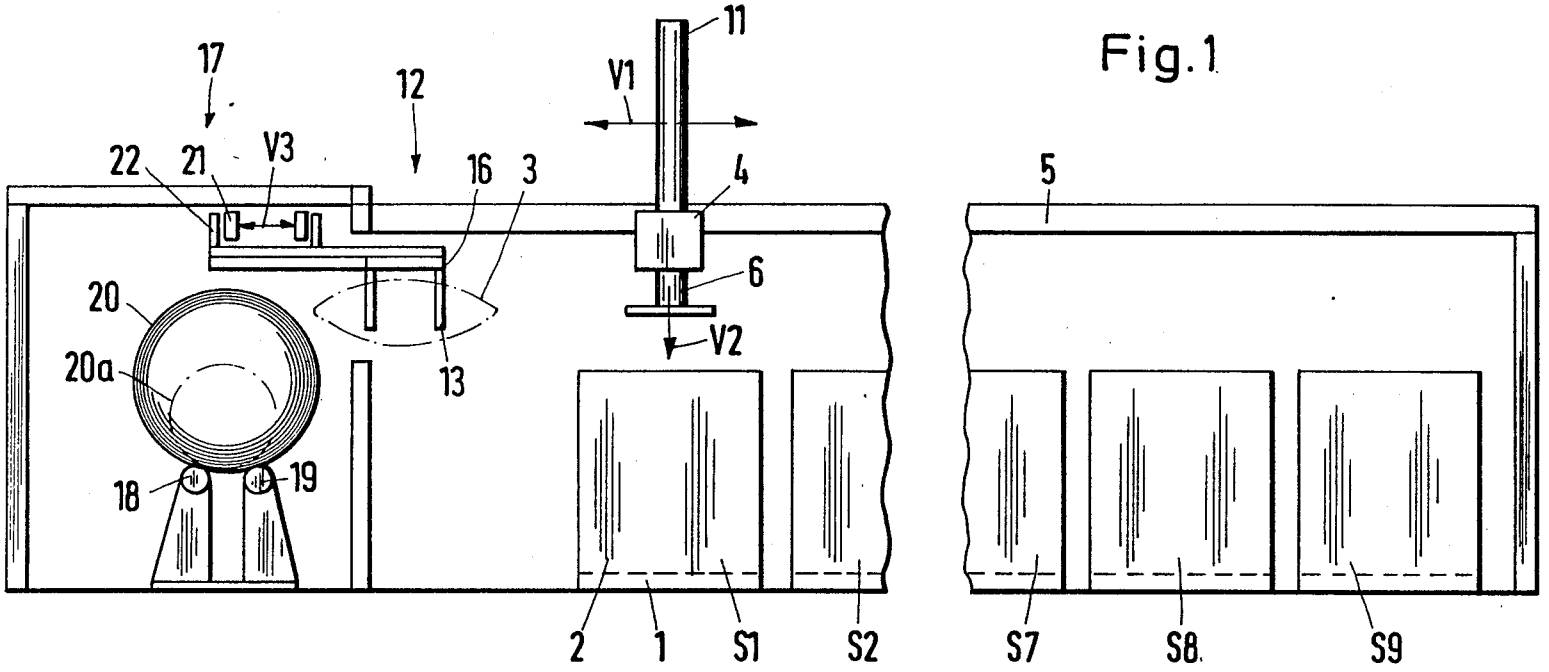
FIG. 1 is a fragmentary schematic side elevational view of an apparatus which embodies one form of the invention and wherein the conveyor means for the transport of components from selected depositories for stacks of components is suspended from an overhead track.
Figure 2:
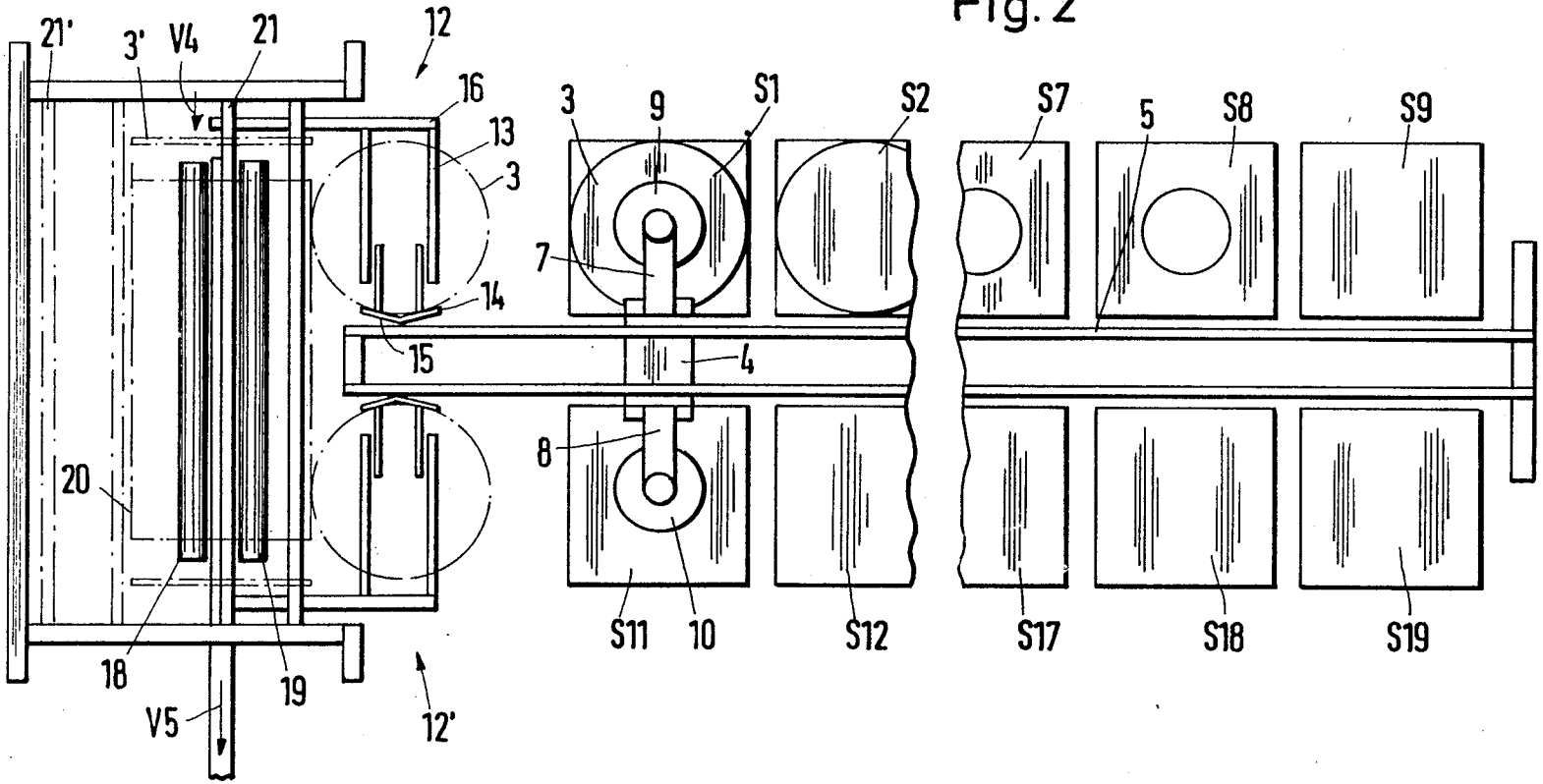
FIG. 2 is a plan view of the structure which is shown in FIG. 1.
Figure 4:
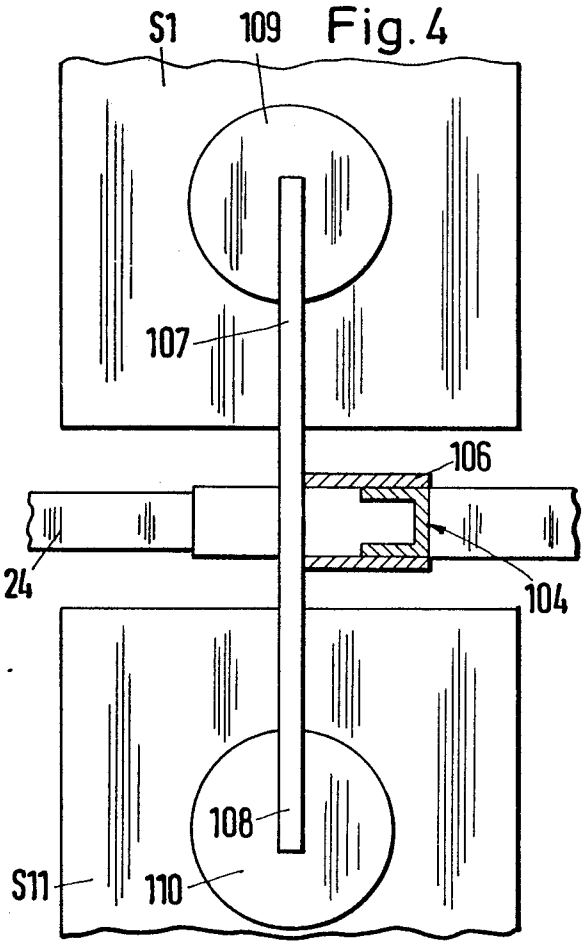
FIG. 4 is a horizontal sectional view substantially as seen in the direction of arrows from the line A—A of FIG. 3.
Figure 3:
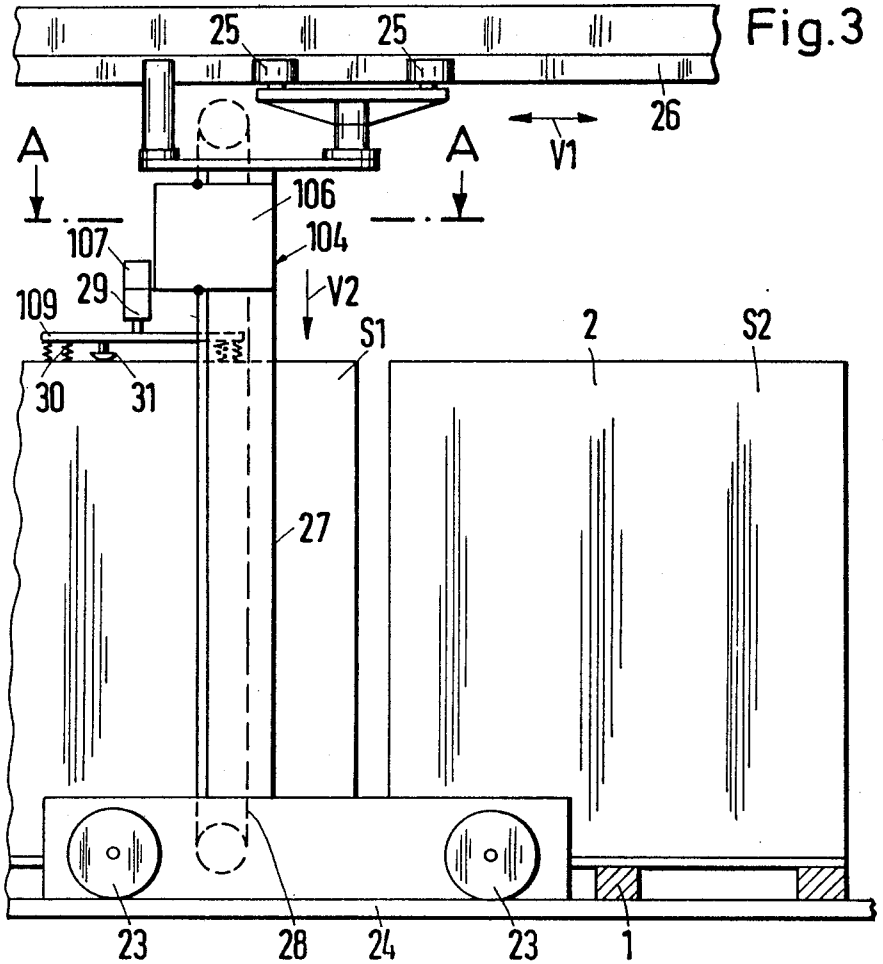
FIG. 3 is a fragmentary central longitudinal vertical sectional view of a second apparatus wherein the conveyor means is arranged to travel along a floor-mounted track and along an overhead track.

The apparatus which is shown in FIGS. 1 and 2 comprises a battery of depositories S1 to S9 and S11 to S19 for stacks or piles 2 of superimposed disc-shaped flat components 3. Such components can be made of wood, paper, plastic, cardboard or any other suitable material which can be employed to make end walls of envelopes for cylindrical objects 20. Each object 20 can constitute a large and heavy roll of convoluted paper having a cylindrical peripheral surface and two flat or substantially flat end faces. The components 3 can constitute inner end walls or outer end walls of envelopes which are used to confine the objects 20 preparatory to storage or shipment. Reference may be had to the aforementioned commonly owned U.S. Pats. Nos. 4,485,612 and 4,596,108.

The battery of depositories comprises a first straight row including the depositories S1–S9 and a second straight row including the depositories S11–S19. The number of depositories can be increased or reduced without departing from the spirit of the invention. The depositories S1 and S11 are disposed opposite each other and store identical components 3 having a first diameter. The depositories S2 and S12 are also disposed opposite each other and contain stacks of identical components 3 having a diameter different from that of components 3 in the depositories S1 and S11. Analogously, the remaining pairs of transversely aligned depositories contain stacks of identical components 3. This renders it possible to simultaneously draw two identical components 3, e.g., from the depositories S8 and S18, for simultaneous orientation and centering preparatory to application to the two end faces of an object 20 which is held in a predetermined orientation and position in a positioning unit 17 adjacent one end of an elongated straight path for a conveyor 4 forming part of a transporting means which further includes an elongated guide in the form of an overhead track 5 for the conveyor 4. The straight elongated path for the conveyor 4 extends between the two rows of depositories S1–S9 and S11–S19.

Each depository includes a standard pallet 1 for a stack 2 of disc-shaped components 3. The arrangement can be such that the diameters of components 3 which are stored in the depositories diminish in the direction of travel of the conveyor 4 away from the positioning unit 17 (i.e., that the diameters of components 3 in the depositories S1 and S11 are larger than those of components 3 in the depositories S2 and S12, and so forth), that the diameters of components 3 increase in a direction toward the positioning unit 17, or that components having different diameters are randomly distributed along the path of the conveyor 4 between the positioning unit 17 and the remotest pair of depositories (S9 and S19).

As can be seen in FIG. 2, at least the pallets 1 in two depositories (e.g., in the remotest depositories S9 and S19) are unoccupied. This is often desirable and advantageous on the following ground: If the supply of components in two confronting depositories (e.g., in the depositories S2 and S12) is practically exhausted, two fresh stacks of components having diameters identical with those of components in the depositories S2 and S12 are introduced into the unoccupied depositories (such as S9 and S19) to thus ensure that the operation of the improved apparatus need not be interrupted in response to exhaustion of supplies of components 3 in a pair of transversely aligned depositories. The depositories S2 and S12 thereupon remain unoccupied until the supplies of components 3 in another pair of transversely aligned depositories are nearly exhausted, and so forth. Thus, the number of depositories can exceed the number of different components 3 by at least one, i.e., the total number of depositories can equal m+n wherein m is the number of different components 3 which are stacked in the apparatus and n is a whole number including one.

The pallets 1 can constitute standard delivery pallets which are suited for transport by fork lift trucks or analogous vehicles. The height of stacks 2 on the pallets 1 is optional and can reach or even exceed six feet which corresponds to the combined thickness of up to 600 standard components 3.

The directions of movement of the conveyor 4 along the overhead track 5 are indicated by a double-headed arrow V1. The exact nature of the motor (not shown) which is used to move the conveyor 4 along the track 5 forms no part of the invention; any conventional trolley type conveyor can be used to transport pairs of components 3 from selected depositories to an orientation changing unit 12 which is installed between the first pair of depositories S1, S11 and the positioning unit 17.

The conveyor 4 comprises an elevator 6 for two arms 7 and 8 which can be moved by the elevator up and down, namely in and counter to the direction which is indicated by arrow V2. Each of the two arms 7, 8 supports a discrete pneumatic lifter 9, 10 constituting a means for carrying components 3 from selected depositories to the orientation changing unit 12. The arms 7 and 8 are arranged to move at levels above the respective rows of depositories S1–S9 and S11–S19, and the elevator 6 can move such arms up and down so that the lifters 9, 10 can pick up components 3 from a selected pair of depositories before the direction of movement of the motor of the conveyor 4 is reversed so as to move the selected pair of components 3 toward the orientation changing unit 12. FIG. 1 shows the cylinder 11 of a fluid-operated (e.g., pneumatic) cylinder and piston unit forming part of the elevator 6 and being operable to move the arms 7, 8 (and hence the lifters 9, 10) up and down toward and away from the topmost components 3 of stacks 2 in two selected depositories. The elevator 6 is operated again upon arrival of the conveyor 4 at the orientation changing station in order to deposit the selected pair of components 3 onto the (then) substantially horizontal supporting surfaces 13 of two bifurcated applying devices 13A serving as a means for simultaneously applying two selected components 3 to the respective end faces of the object (roll) 20 in the positioning unit 17. The fluid-operated elevator 6 can be replaced with another suitable elevator, e.g., with an elevator employing a rack and pinion drive which can move the arms 7, 8 and the respective lifters 9, 10 in and counter to the direction which is indicated by the arrow V2.

The orientation changing unit 12 comprises two mirror symmetrical halves or sections 12' which are disposed at opposite sides of a vertical plane extending at right angles to the axis of the roll 20 in the positioning unit 17 and halving the space between the two rows of depositories S1-S9 and S11-S19. Since the two halves or sections 12' of the orientation changing unit 12 are identical, only one of these sections is shown in detail in FIGS. 1 and 2. Each of the sections 12' comprises a bifurcated applying device 13A with two prongs defining a supporting surface 13 for discrete components 3. The supporting surface 13 cooperates with two stops 14, 15 having mutually inclined straight contact surfaces which make an oblique angle and serve as abutments for two spaced-apart portions of a component 3 on the supporting surface 13. When the component 3 on the supporting surface 13 abuts the contact surfaces of the stops 14, 15, such component is properly positioned or centered to be applied to the respective end face of the roll 20 in the positioning unit 17. The supporting surface 13 receives a component 3 from the respective lifter (9 or 10) in response to lowering of the arms 7, 8 by the elevator 6 or simply in response to termination of the application of suction to the underside of the lifter 9 or 10 at a time when such lifter is located at a level above the respective supporting surface 13. At such time, the applying device 13A maintains its supporting surface 13 in a substantially horizontal plane.

The orientation changing unit 12 further comprises means for pivoting the applying devices 13A about the horizontal axes of pivot members 16 (one for each of the sections 12') which serve to move the supporting surfaces 13 between horizontal positions (for reception of components 3 from the lifter 9 or 10) and vertical positions in which the freshly transferred components 3 are ready for application to the respective end faces of the roll 20 in the positioning unit 17. The component 3 on a supporting surface 13 is caused to slide by gravity against the contact surfaces of the respective pair of stops 14, 15 therebelow in response to pivoting of the applying device 13A from the horizontal to the vertical position so that the component is automatically centered prior to being moved against the respective end face of the roll 20. The applying device 13A is preferably provided with suction ports (not specifically shown) which attract the component 3 to the supporting surface 13 as soon as the component engages the contact surfaces of both stops 14, 15, and the application of suction thereupon continues until the component 13 is ready to be affixed to the end face of the roll 20 in the positioning unit 17, namely directly to such end face or to the end portions of a tubular wrapper which surrounds the peripheral surface of the roll 20 and is folded over the end faces of the roll. Reference may be had again to the aforementioned commonly owned U.S. Pats. Nos. 4,485,612 and 4,596,108. The exact manner of applying suction to a component 3 on the supporting surface 13 and of terminating the application of suction to such component forms no part of the invention. Suitable suction applicators are well known in paper making, paper processing and many other industries.

The positioning unit 17 includes two parallel horizontal cylindrical members 18, 19 in the form of idler rolls which constitute carriers for discrete rolls 20 and are designed to maintain the roll in the unit 17 in a predetermined position, preferably in such a way that the axis of the properly positioned roll is horizontal or nearly horizontal and both end faces of the roll are accessible for the application of a pair of components 3. The carriers 18, 19 contact two spaced apart portions of the peripheral surface of the roll 20 in the positioning unit 17. The mutual spacing of regions of contact between the carriers 18, 19 and the roll 20 in the positioning unit 17 equals or approximates the mutual spacing of regions of contact between a component 3 on a supporting surface 13 and the mutually inclined straight contact surfaces of the respective stops 14, 15. This contributes to reliability and predictability of the centering action before the component is actually caused to adhere to the adjacent end face of the roll 20 in the positioning unit 17.

The orientation changing unit 12 further comprises a device 21 which can be moved along a relatively short path between the solid-line position and the phantom-line position 21' of FIG. 2. The purpose of the device 21 is to move the respective applying device 13A from the station where the device 13A is pivoted between horizontal and vertical positions and the station where the device 13A (in vertical position) maintains the component 3 resting on the stops 14, 15 in a position of register with the respective end face of the roll 20 in the positioning unit 17. The device 21 is movable back and forth in directions which are indicated by a double-headed arrow V3. The arrow V4 indicates the direction of movement of the device 21 toward the adjacent end face of the roll 20 in order to apply a component 3 to such end face, e.g., to a film of adhesive which coats the external surface of that end portion of a wrapper which overlies the respective end face of the roll 20 in the positioning unit 17. The position of a component 3 prior to movement of the device 21 in the direction of arrow V4 is shown by phantom lines, as at 3'. The device 21 is movable relative to a carriage 22 which, in turn, is movable in and counter to the direction of arrow V4. The device 21 can be moved on the carriage 22 by a first rack and pinion drive, and a second rack and pinion drive can be used to move the carriage 22 toward and away from the adjacent end face of a roll 20 in the positioning unit 17. It is equally possible to replace one or each of the just mentioned rack and pinion drives with a hydraulic or pneumatic motor or with any other suitable prime mover means which is capable of moving the device 21 in directions indicated by arrow V3 and of moving the carrier 22 in and counter to the direction of arrow V4. It is equally within the purview of the invention to mount the device 21 solely for movement in directions which are indicated by the double-headed arrow V3 and to mount the carriage 22 on the device 21 for movement in and counter to the direction which is indicated by the arrow V4. In such apparatus, the applying device 13A is mounted on the carriage 22.

A component 3 which constitutes the topmost disc-shaped panel of a stack 2 of such components in one of the depositories (e.g., in the depository S1) is manipulated as follows: In the first step, the conveyor 4 is caused to advance along the track 5 to the position which is shown in FIG. 2, i.e., the arm 7 maintains the lifter 9 at a level above the central portion of the topmost component 3 of the stack 2 on the pallet 1 in the depository S1. The lifter 9 attracts the topmost component 3 by suction subsequent to lowering of the arm 7 by the elevator 6, and the elevator 6 thereupon lifts the arm 7 with the lifter 9 and with the component 3 which is attracted to the underside of the lifter. The conveyor 4 is then moved to the orientation changing unit 12 in order to move the lifter 9 above the applying device 13A of the respective section 12'. At such time, the device 13A maintains the supporting surface 13 in or close to a horizontal position. The elevator 6 lowers the arm 7 and the lifter 9 (if necessary) before the suction port or ports of the lifter 9 are disconnected from the suction generating device (not shown) so that the component 3 descends onto the supporting surface 13. The elevator 6 may but need not raise the lifter 9 before the applying device 13A is caused to pivot about the axis of the shaft 16 (this shaft forms part of a means for changing the inclination of the supporting surface 13) so that the component 3 on the surface 13 begins to slide under the action of gravity until it engages the contact surfaces of the stops 14 and 15. The supporting surface 13 then begins to attract the thus centered component 3 by suction and the stops 14, 15 are retracted by retracting means 90 into or behind the supporting surface 13 so that they are out of the way and cannot interfere with movements of the component 3 all the way into contact with the adjacent end face of the roll 20 in the positioning unit 17. In the next step, the device 21 moves from the solid-line position to the phantom-line position 21' before the carriage 22 moves the component 3 from the position 3' to a position of engagement with the adjacent end face of the roll 20. The carriage 22 is then retracted by moving counter to the direction which is indicated by the arrow V4.

A second component 3 is applied to the other end face of the roll 20 in the positioning unit 17 in the same way as described above so that the roll is provided with two inner end walls or with two outer end walls in a simultaneous operation.

The roll 20 is then removed from the positioning unit 17 in the direction of arrow V5 upon return movement of the respective applying device 13A to its starting position in which the supporting surface 13 is ready to receive a component 3 from the lifter 10. The withdrawn roll 20 is transported to storage or to a further processing station, not shown, and the positioning unit 17 is ready to receive a; fresh roll (e.g., a smaller-diameter roll 20*a* which is indicated in FIG. 1 by phantom lines). The conveyor 4 is thereupon caused to move to the depositories (such as S8 and S18) which contain stacks 2 of components suitable for application to the end faces of the smaller-diameter roll 20*a*, and the afore-discussed procedure is repeated, i.e., two components are withdrawn from the depositories S8, S18, such components are moved to the orientation changing unit 12, and the orientation of the components is thereupon changed prior to their application to the respective end faces of the roll 20*a* on the carriers 18, 19.

FIG. 1 shows one section of the orientation changing unit 12 in the process of changing the inclination of the component 3 on the respective supporting surface 13. The component (3'') is already inclined with reference to a horizontal plane but is yet to assume the vertical position in which it is parallel to the end faces of a roll on the carriers 18, 19.

An advantage of the improved apparatus over apparatus of the type disclosed in U.S. Pat. No. 4,596,108 is that the depositories for stacks of components 3 are disposed next to rather than above each other. This renders it possible to store large supplies of stacked components 3 in each of the depositories or in a selected number of depositories. The height of a stack 2 can exceed 6 feet and can reach or even exceed 2000 mm. This ensures that the replenishment of supplies of components at the depositories need not take place at frequent intervals.

Another advantage of the improved apparatus is that it is not necessary to stack the components 3 in their depositories with a high degree of accuracy because the orientation changing unit 12 ensures proper orientation and centering of components on their way from selected depositories to the positioning unit 17. This renders it possible to deliver pallets 1 with stacks 2 of components 3 thereon to depositories, wherein the supplies of components are depleted, with a standard fork lift truck or another suitable vehicle without the need for highly accurate positioning of pallets 1 adjacent the path of movement of the conveyor 4. Consequently, it is not necessary to waste much time for highly accurate positioning of pallets 1 in the respective depositories, as long as the components 3 in the depositories are within the range of the lifter 9 or 10. The depositories are readily accessible to vehicles which deliver loaded pallets 1 and/or remove empty pallets because all depositories are located at the floor level. Manual labor is not needed for any stage of the operation which is particularly important in connection with the replenishment of supplies of components 3 in the depositories. Thus, it is possible to manipulate large, bulky and heavy accumulations of components 3 because such accumulations need not be lifted and/or otherwise moved by hand. This contributes significantly to a higher output of the improved apparatus.

While it is possible to employ a first set of pallets for delivery of fresh supplies of components 3 to pallets in the depositories wherein the supplies of components are depleted, it is preferred to first remove empty pallets and to thereupon replace such empty pallets with loaded pallets to thus even further shorten the intervals of time which are needed to restore the supplies of components in the depositories.

It is possible to provide the apparatus of FIG. 1 with an orientation changing unit 12 having two sections 12' which are operable independently of each other. This enhances the versatility of the apparatus because each of the two sections can be used for reception and reorientation and centering of different components 3. However, the illustrated arrangement wherein the two sections 12' of the orientation changing unit 12 are operated simultaneously in order to manipulate pairs of identical components 3 is preferred at this time because it is normally desirable to provide each roll 20 or 20*a* with a pair of identical disc-shaped components and also because it is simpler to automate the operation of the apparatus if the two sections 12' are operated in synchronism. Moreover, the apparatus can be simplified to a considerable extent if a single conveyor 4 can be used to deliver components 3 to two identical sections 12' of the orientation changing unit 12.

The utilization of an overhead track 5 for the conveyor 4 renders it possible to ensure that the apparatus affords access to the orientation changing unit 12 and to those sides of the depositories S1-S9 and S11-S19 which are adjacent the path of movement of the conveyor. Moreover, the track 5 is out of the way and can be placed at any desired practical level so that the suspended conveyor 4 can pick up the topmost disc-shaped components of very tall stacks 2 of components on the pallets 1 in selected depositories.

The provision of a conveyor 4 with two mirror symmetrical arms 7, 8 for the respective lifters 9, 10 exhibits the advantage that the loads upon the conveyor, and hence upon the track 5, are balanced because each of the lifters 9, 10 carries a component 3 when the conveyor 4 is in the process of advancing toward the orientation changing unit 12.

An advantage of the feature that the mutual positions of regions of contact between the straight contact surfaces of the stops 14, 15 and the disc-shaped component on the respective supporting surface 13 correspond to mutual spacing of regions of contact between a roll 20 or 20*a* and the carriers 18, 19 is that the centering of a component on the supporting surface 13 merely requires a simple translatory movement of the component under the action of gravity and that the centering operation is completed as soon as the component engages the two contact surfaces. While it is possible to replace the straight contact surfaces on the stops 14, 15 with convex (particularly partly cylindrical) contact surfaces, it has been found that the provision of straight contact surfaces often suffices to achieve an accurate centering action so that the thus centered components can be applied to the end faces of a roll 20 or 20a in optimum positions, for example, in such a way that the center of each applied component is located on the axis of the roll in the positioning unit 17.

FIGS. 3 to 10 show a second apparatus. All such parts which are analogous to corresponding parts of the apparatus of FIGS. 1 and 2 are denoted by similar reference characters plus 100. The guide means for the conveyor 104 of the second apparatus comprises a floor-mounted track 24 and an overhead track 26. The track 24 supports a carriage having wheels 23 which can travel between two rows of depositories (FIGS. 3 and 4 merely show the depositories S1, S2 and S11) under the guidance of the track 26 which is engaged by roller followers 25 of the conveyor 104. The provision of a lower track 24 contributes to simplicity of the conveyor 104 which need not be suspended from but is merely guided along the upper track 26.

The elevator 106 of the conveyor 104 is movable up and down along a column 27 and comprises a belt conveyor or chain conveyor 28 for two horizontal arms 107, 108 supporting discrete lifters 109, 110. The elevator 106 can move the lifters 109, 110 up and down, i.e., counter to and in the direction of arrow V2. The conveyor 104 further comprises means for adjusting the levels of the lifters 109, 110 relative to the elevator 106 and arms 107, 108. Such adjusting means comprises fluid-operated (e.g., pneumatic) cylinder and piston units 29 which can be actuated to move the respective lifters all the way into contact with the topmost components 3 of selected stacks 2 or to carry out the initial stages of raising the lifters 109, 110 and the components 3 which adhere to such lifters preparatory to movement of the conveyor 104 toward the orientation changing unit 112 (see particularly FIGS. 5 to 8 and 10). The underside of each lifter carries an annulus of suction cups 30 (four of these suction cups are shown schematically at the underside of the lifter 109 in FIG. 3), and each of the lifters 109, 110 further carries a limit switch 31 which can arrest the adjusting means 29 and/or the elevator 106 when the respective lifter 109 or 110 is in an optimum position to pick up a component 3 in response to connection of the respective annulus of suction cups 30 to a suitable suction generating device, e.g., to the intake of a suction fan, not shown.

The main purpose of the adjusting means 29 is to compensate for eventual differences in the height of pallets 1 at the depositories for stacks 2 of components 3. It is desirable to provide two adjusting means 29, one for the lifter 109 and the other for the lifter 110. This renders it possible to compensate for different heights of pallets 1 at two transversely aligned depositories, e.g., at the depositories S1 and S11 of FIG. 4.

Figure 7:
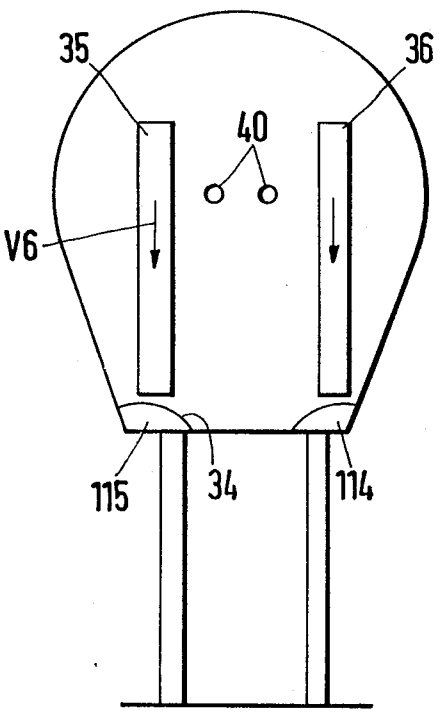
FIG. 7 is a front elevational view as seen from the left-hand side of FIG. 6.
Figure 6:
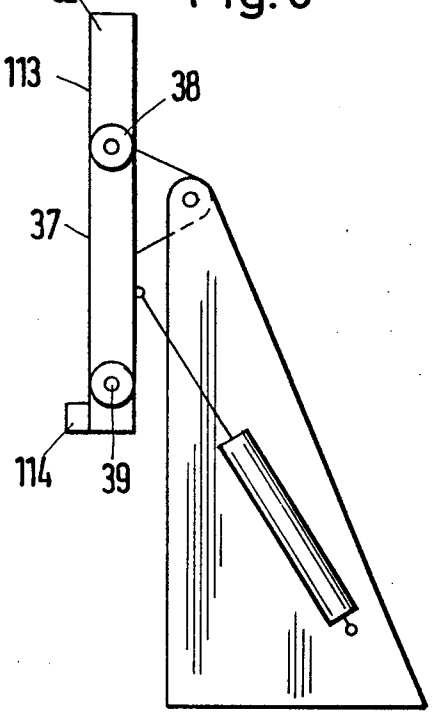
FIG. 6 shows the structure of FIG. 5 with the supporting surface, moved into a substantially vertical plane.
Figure 8:
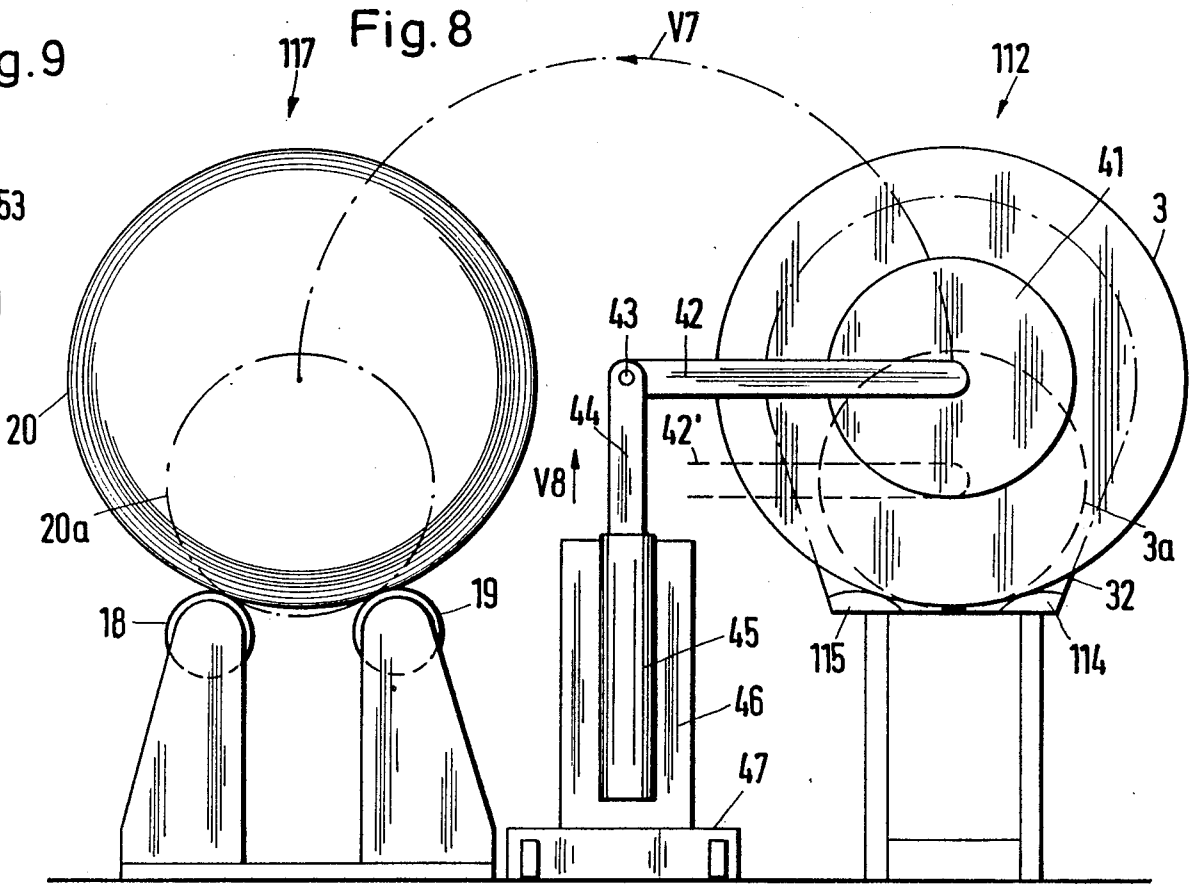
FIG. 8 illustrates another portion of the orientation changing, means in the apparatus of FIGS. 3 and 4.
Figure 9:
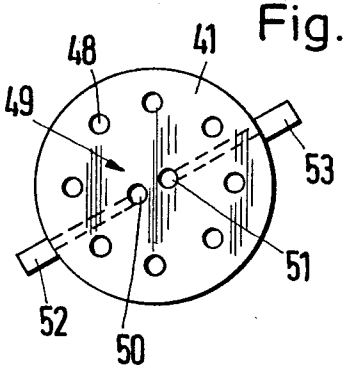
FIG. 9 is a front elevational view of a substantially circular plate-like member which can apply properly oriented components to end faces of successive objects in the positioning unit of the apparatus which is shown in FIGS. 3 and 4.

The details of the orientation changing unit 112 are shown in FIGS. 5 to 8 and 10. This unit also comprises two mirror symmetrical sections (see FIG. 10); therefore, FIGS. 5 to 8 merely show the details of one of these sections. Each section of the orientation changing unit 112 comprises a tiltable platform 32 which serves as a means for moving the respective supporting surface 113 between a horizontal position (FIG. 5) and a vertical position (FIGS. 6 to 8). The actual supporting surface 113 is formed by the exposed reaches of two endless belt-shaped conveying devices 35, 36 which are mounted in the platform 32 and can be driven in directions indicated by arrows V6 (FIG. 7) when, or even before, the platform 32 assumes the vertical position of FIGS. 6 to 8. This ensures that a component 3 on the two-part supporting surface 113 is positively moved toward engagement with the partly cylindrical convex contact surfaces 34 of two stops 114, 115 on the platform 32. The platform 32 is further provided with suction ports 40 which can form part of means for attracting a properly centered component 3 to the exposed reaches of the conveying devices 35, 36 and/or directly to the exposed surface of the platform 32 as soon as the edge face of the component on the supporting surface 113 reaches the convex contact surfaces 34 of the stops 114, 115. These stops need not be retracted into the platform 32 because each section of the orientation changing unit 112 comprises a discrete applying device 41 which serves to accept properly oriented and centered components 3 from the respective platform 32 (while the latter is held in the vertical position of FIGS. 6 to 8) and to transfer such components into the positioning unit 117 in such a way that the transferred components are ready for application to the respective end faces of successive rolls 20 or 20a on the carriers 18, 19 of the unit 117.

The means for changing the inclination of the platform 32 comprises a fluid-operated (e.g., pneumatic) cylinder and piston unit 33 which is mounted on a frame member in the respective section of the unit 112 and has a piston rod which is articulately connected to the platform 32. The latter is pivotable about the horizontal pintle of the hinge on the frame member.

The exposed surfaces of the conveying devices 35 and 36 are preferably roughened to ensure a highly satisfactory frictional engagement with the disc-shaped component on the platform 32. This even more reliably guarantees that such component 3 is moved into engagement with the convex contact surfaces 34 of the stops 114 and 115. The radii of curvature of convex surfaces 34 preferably match the radii of carriers 18, 19 in the positioning unit 117, and the mutual spacing of centers of curvature of contact surfaces 34 preferably matches the distance between the axes of the carriers 18, 19. This ensures that a disc-shaped component which abuts the convex surfaces 34 is properly centered for application to one end face of the roll 20 or 20a on the carriers 18, 19 of the positioning unit 117.

Each of the two conveying devices 35, 36 on the platform 32 comprises an endless flexible belt 37 which is trained over two pulleys 38, 39 (see FIG. 6). The suction ports 40 are provided in the platform 32 between the conveying devices 35, 36; as mentioned above, the ports 40 are connected to a suitable suction generating device as soon as the disc-shaped component on the platform 32 moves into abutment with the contact surfaces 34 of the stops 114 and 115. This can take place while the platform 32 is still maintained in the horizontal position of FIG. 5 because the component on the platform 32 need not descend onto the stops 114, 115 under the action of gravity.

Each section of the orientation changing unit 112 further comprises the aforementioned applying device 41 which is a circular member serving to affix or apply properly centered components to the end faces of rolls on the carriers 18, 19 of the positioning unit 117. The member 41 is movable between a first position (shown in FIG. 8 by solid lines) in which it registers with a component (e.g., the component 3) on the stops 114, 115 (while the platform 32 is maintained in the vertical position of FIGS. 6, 7 and 8) and a second position of registry with one end face of a roll 20 on the carriers 18 and 19. The means for moving the member 41 in a vertical plane between its first and second positions includes a lever 42 which is mounted for pivotal movement about the axis of a driven shaft 43 along an arcuate path which is indicated by the phantom-line arrow V7.

The shaft 43 is movable up and down by a level changing device including a hydraulic or pneumatic cylinder 45 on a holder 46 and a piston rod 44 which is reciprocable relative to the cylinder 45 and supports the shaft 43. The holder 46 is mounted on a carriage 47 which constitutes a means for advancing the cylinder 45, piston rod 44, shaft 43 and lever 42 in parallelism with the axis of the roll 20 or 20*a* in the positioning unit 117. The piston rod 44 can move the shaft 43 in and counter to the direction of arrow V8, and the carriage 47 can move the shaft 43 and the lever 42 at right angles to the plane of FIG. 8. The lever 42 maintains the member 41 in the solid-line position of FIG. 8 if the carriers 18, 19 support a relatively large roll 20. If the roll 20 is replaced with a smaller roll 20*a* (indicated by phantom lines), the motor including the cylinder 45 is actuated to lower the lever 42 to the position 42′ so that the member 41 can accept a smaller-diameter component 3*a* which will be used as an end wall at one end face of the roll 20*a*. The component 3*a* which is ready to be accepted by the member 41 rests on the convex contact surfaces 34 of the stops 114, 115.

Figure 10:
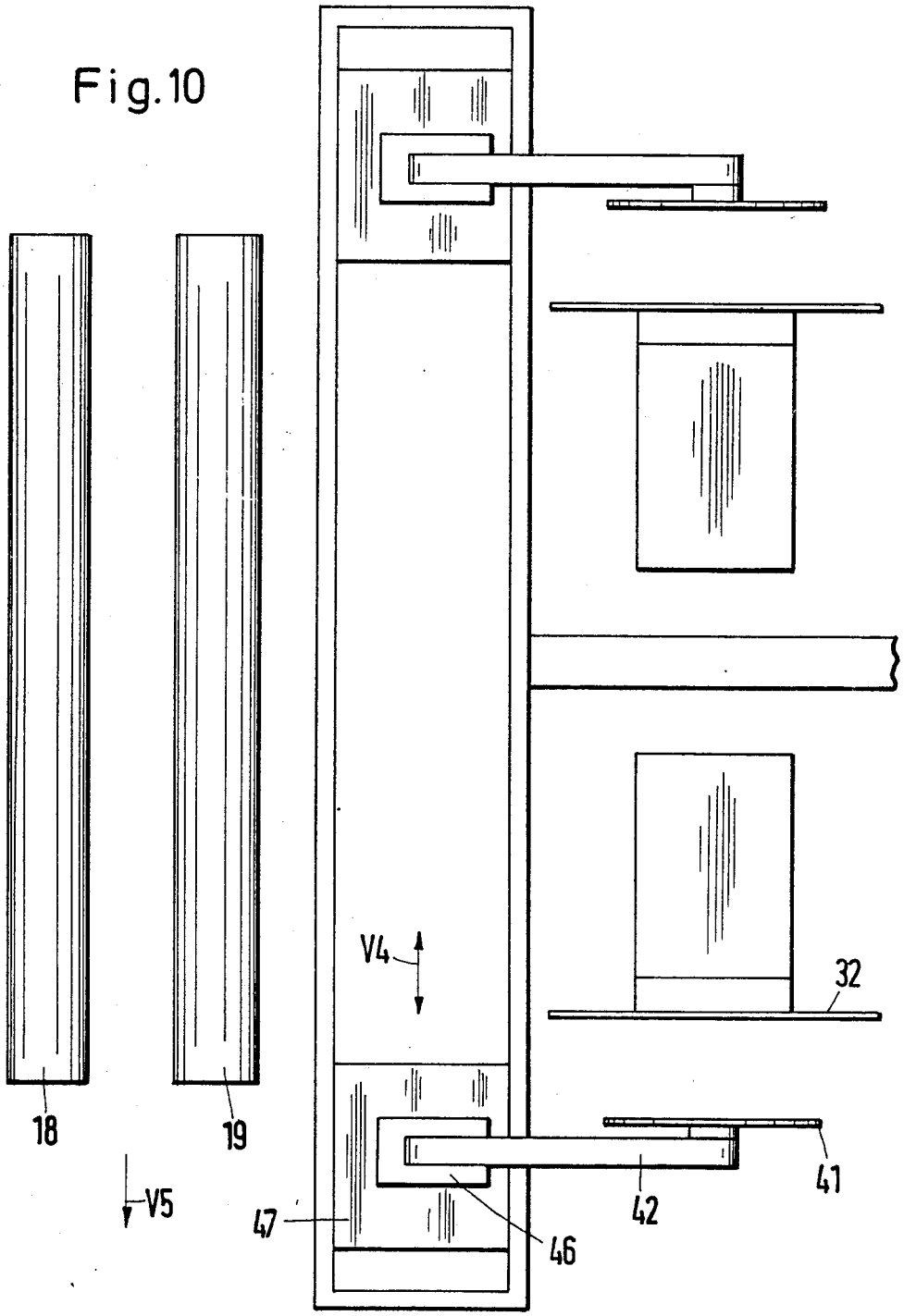
FIG. 10 is a plan view of the structure which is shown in FIG. 8.

The fluid-operated motor including the cylinder 45 and piston rod 44 can be replaced with a rack-and-pinion drive to move the shaft 43 and the lever 42 up and down. It is also possible to mount the shaft 43 on a nut meshing with a rotary spindle which is driven by a reversible electric or other motor capable of moving the nut and the shaft 43 with the lever 42 up or down. The carriage 47 can support a motor-driven pinion mating with a rack in the floor beneath the carriage 47 so that the pinion can cause the carriage to move in parallelism with the axes of the carriers 18, 19 toward or away from the observer of FIG. 8. The carriage 47 serves as a means for moving a component 3 or 3*a* on the member 41 against the adjacent end face of the roll 20 or 20*a* in the positioning unit 117 when the transfer of the member 41 in the direction of arrow V7 is completed, i.e., when the center of the component 3 or 3*a* is already located on an extension of the axis of the roll 20 or 20*a* . The directions in which the carriage 47 is movable along the floor are indicated by arrow V4 (see FIG. 10). FIG. 10 shows the track 147 which confines the two carriages 47 to movements in the directions of arrows V4 and V5, i.e., in parallelism with the axes of the carriers 18 and 19.

That side of the member 41 which confronts a component 3 or 3*a* resting on the stops 114, 115 is provided with suction ports 48 (FIG. 9) which are connected to the intake of a suction generating device (e.g., a fan) as soon as the member 41 moves to a position of overlap with the component 3 or 3*a*, and the ports 48 thereupon attract the component 3 or 3*a* until the latter is ready to be applied to one end face of the roll 20 or 20*a*.

The member 41 further supports a fastener driving device 49 having hammers 50 in line with two apertures 51, and channels 52, 53 for delivery of staples or other suitable fasteners which are used to secure the central portions of components 3 or 3*a* to the respective rolls 20, 20*a*. The exact construction of the fastener driving device 49 (which is preferably located at the center of the member 41) forms no part of the present invention.

FIG. 8 shows that the radii of curvature of convex contact surfaces 34 on the stops 114, 115 match the radii of the carriers 18, 19 as well as that the centers of curvature of the two contact surfaces are spaced apart from each other a distance corresponding to that between the axes of the carriers 18, 19. This ensures that the stops 114, 115 can properly orient and center large-, medium- or small-diameter disc-shaped components with the same degree of accuracy (it is assumed here that the diameter of a component 3 matches that of the roll 20 and that the diameter of the roll 20*a* matches that of the component 3*a*, i.e., that the diameter of each component to be applied in the positioning unit 117 matches or closely approximates the diameter of the roll to which the component is to be applied by the member 41).

The mode of operation of the fully illustrated section of the orientation changing unit 112 is as follows: Once a component 3 is moved (by the conveying devices 35, 36) into engagement with the stops 114, 115 on the platform 32 and the platform is moved to the vertical position of FIGS. 6, 7 and 8, the carriage 47 is caused to move the member 41 in a direction toward the exposed side of the component 3 and the suction ports 48 are connected to the suction generating device (while the ports 40 are disconnected from the same or from a different suction generating device) so that the component 3 is transferred from the platform 32 onto the member 41. The carriage 47 then retracts the member 41 and the component 3 from the platform 32, and the motor (not shown) for the shaft 43 is started to pivot the lever 42 from the solid-line position of FIG. 8 (see the arrow V7) so that the component 3 is moved to a position of register with the roll 20 on the carriers 18, 19. The carriage 47 is then started to move the member 41 and the component 3 thereon toward the adjacent end face of the roll 20, and the fastener driving device 49 is actuated to affix the component 3 to the roll 20. The ports 48 are disconnected from the suction generating device, the carriage 47 retracts the member 41, and the lever 42 is pivoted by the motor for the shaft 43 to move back to the solid-line position of FIG. 8. The lever 42 is arranged to pivot through angles of approximately or exactly 180°.

The staples or other fasteners which are supplied via channels 52, 53 and are driven home by the hammers 50 via apertures 51 of the member 41 can be driven into the respective end face of a core (not shown) for the convoluted supply of paper or Alternatively, and if the core for convoluted web material constitutes a sleeve, the end portions of such sleeve normally receive plugs and the fasteners are then driven into one of these plugs.

The mode of transferring smaller disc-shaped components 3*a* is analogous to the just described mode of transferring larger components 3. The main difference is that the conveyor 104 delivers smaller components 3*a* from a different pair of depositories and that the level changing means 44, 45 must be actuated to lower the shaft 43, the motor for the shaft 43 and the lever 42 so that the lever 42 assumes the position 42′ of FIG. 8 and the member 41 is then ready to accept a component 3*a* resting on the contact surfaces 34 of the stops 114, 115 (in vertical position of the platform 32). The stops 114, 115 need not be retracted into the platform 32 because the latter does not constitute a means for applying components 3 or 3*a* to the end faces of rolls 20 or 20*a*; the function of an applying means is performed by the member 41. Once the lever 42 has been lowered to the position 42′, it is ready to be pivoted through approximately or exactly 180° so as to place the component 3*a* into register with the adjacent end face of the roll 20*a* on the carriers 18, 19.

The guide means for the conveyor 104 exhibits the advantage that the conveyor is confined to movements along an accurately determined path because it is guided from below (at 24) as well as from above (at 26). This is important when the stacks 2 in the depositories are very high, e.g., in excess of six feet. The upper track 26 serves primarily to prevent any tilting or similar stray movements of the conveyor 104, of its elevator 106 and of its arms 107, 108 for the respective lifters 109, 110.

The orientation changing unit 112 is bulkier and more complex than the orientation changing unit 12 because the parts (platforms 32) which receive components from the conveyor 104 do not constitute the means for applying components to the end faces of rolls in the positioning unit 117 (the applying means includes the members 41). However, the orientation changing unit 112 exhibits the important advantage that the platforms 32 are ready to receive fresh components from the respective lifters 109, 110 while the members 41 are in the process of transporting previously supplied components toward the carriers 18, 19 and of applying the components to the end faces of the roll in the positioning unit 117. Furthermore, the orientation changing unit 112 in the apparatus of FIGS. 3 to 10 need not employ retractible stops for components on the respective supporting surfaces 113 because the stops 114, 115 do not interfere with the transfer of components from the supporting surfaces 113 onto the respective members 41 and the stops are not moved all the way to the positioning unit 117. Another advantage of the orientation changing unit 112 is that the members 41 need not change their inclination during any stage of movement relative to the conveyor 104, platforms 32 and positioning unit 117. In other words, the members 41 can remain in vertical planes or in planes which are parallel to the end faces of rolls in the positioning unit 117.

Figure 11:
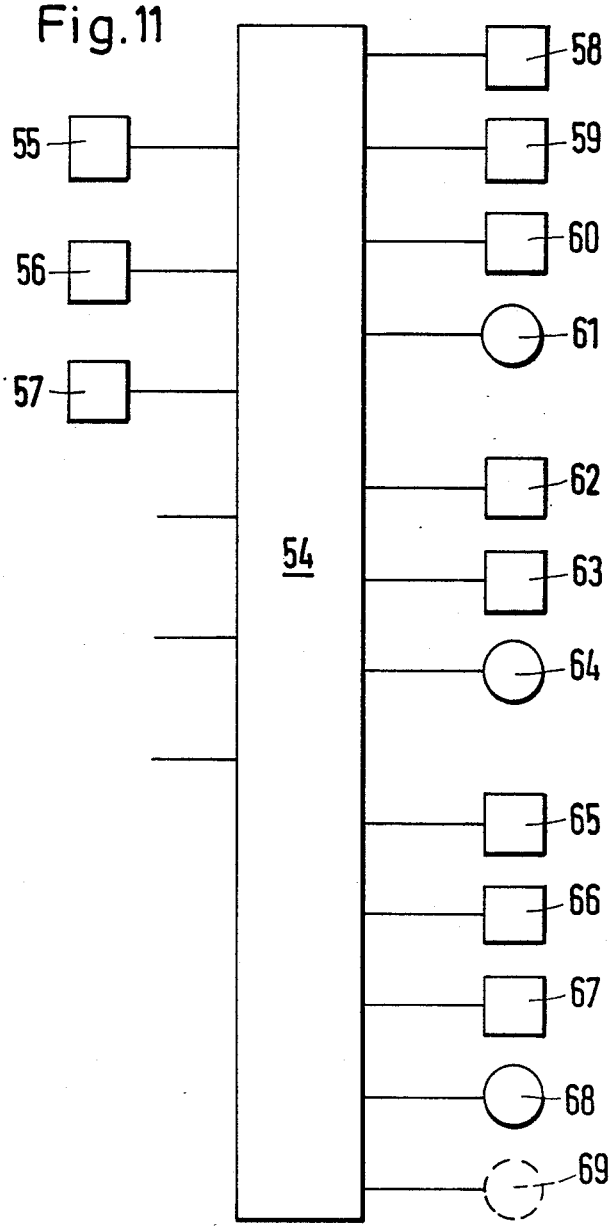
FIG. 11, is a diagram of a control circuit for the improved apparatus.

The means for operating the improved apparatus preferably comprises a computer 54 (FIG. 11). This computer comprises a first input 55 for signals denoting the sizes of disc-shaped components which are stored in the depositories S1–S9 and S11–S19. A second input 56 serves for reception of additional data, for example, the presence or absence of components in the depositories. A third input 57 is connected with an output element (not shown) which monitors the diameter of the roll (such as 20 or 20*a*) in the positioning unit 17 or 117. The monitoring device in the unit 17 or 117 can constitute a standard photoelectronic detector which is designed to ascertain the diameter of the roll resting on the carriers 18, 19. The same holds true for the monitoring means which transmit signals to the input 54 and serve to determine the diameters of stacks 2 of disc-shaped components in the various depositories. The diameters of rolls in the positioning unit 17, 117 need not be measured from roll to roll if the operation of means for delivering successive rolls to the positioning unit 17 or 117 is programmed so that the unit 17 or 117 receives a predetermined number of successive rolls having identical diameters.

A first output 58 of the computer 54 transmits signals to the motor of the conveyor 4 or 104, i.e., this output transmits signals which are used to move the conveyor 4 or 104 in the directions indicated by arrows V1.

A second output 59 of the computer 54 transmits signals to the elevator 6 or 106 to initiate movements in and counter to the directions indicated by arrows V2.

A third output 60 serves to transmit signals to the adjusting means 29 of the apparatus which is shown in FIGS. 3 to 10 or to analogous adjusting means (if any) in the apparatus of FIGS. 1 and 2.

A fourth output 61 transmits signals which initiate or terminate the application of suction to the cups 30 of the lifters 109, 110.

Figure 5:
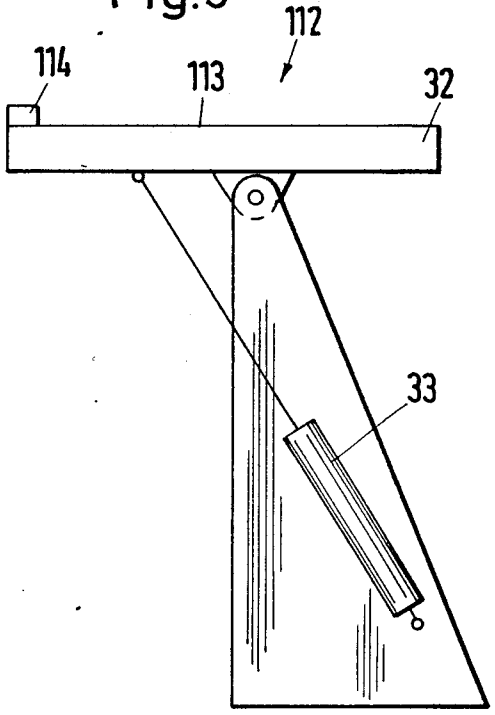
FIG. 5 is a side elevational view of a portion of the orientation changing means in the apparatus of FIGS. 3 and 4, the supporting surface for discrete components being shown in a horizontal position.

A fifth output 62 is provided to transmit signals to the motor 33 which pivots the platform 32 between the positions which are shown in FIGS. 5 and 6, and a sixth output 63 of the computer 54 transmits signals which start or arrest the motor or motors for the conveying devices 35, 36 on the tiltable platform 32. A seventh output 64 transmits signals for the application or termination of application of suction to the ports 40 in the platform 32. An eighth output 65 transmits signals for actuation or deactivation of the means 44, 45 for changing the level of the shaft 43 for the lever 42 (movements in and counter to the direction of arrow V8), and a ninth output 66 transmits signals to the motor for the shaft 43, i.e., for causing pivotal movements of the lever 42 in and counter to the direction of arrow V7. A tenth output 67 transmits signals which initiate or terminate the movements of the motor for the carriage 47 (arrow V4), and an eleventh output 68 transmits signals for the application or termination of application of suction to the ports 48 of the member 41 The computer 54 further comprises a twelfth output 69 for signals which regulate the operation of the fastener driving means 49.

Signals which are transmitted by the outputs 58 and 65 are dependent upon signals which are transmitted to the input 57, i.e., upon the diameter of the roll on the carriers 18, 19 of the positioning unit 17 or 117. Such diameter is or can be identical with the diameters of components which are to be delivered to the positioning unit 17 or 117 (it being assumed here that the diameter of a component 3 matches or approximates the diameter of a roll 20, that the diameter of a component 3*a* matches or approximates the diameter of a roll 20*a*, and so forth).

The improved apparatus (e.g., that which is shown in FIGS. 3 to 10) is designed to be operated in such a way that the conveyor 104 can accept a pair of components (such as 3 or 3*a*) from a selected pair of transversely aligned depositories and delivers the thus accepted pair of components to the respective sections of the orientation changing unit 112. Once the components are moved into vertical planes in response to pivoting of the platforms 32 to the positions corresponding to that of the platform which is shown in FIG. 6, the members 41 are caused to take over the components from the platforms and to deliver them to the respective end faces of the roll in the positioning unit 117 before the components are fastened (such as stapled) to the roll. All such operations are carried out in a proper and rapid sequence in response to signals from the computer 54. The conveyor 104 can proceed to pick up a fresh pair of components even before the components of the preceding pair are affixed to the end faces of the roll in the positioning unit 117. This contributes to a higher output of the apparatus.

The platforms 32 can be pivoted back to their horizontal positions (FIG. 5) as soon as the respective members 41 are out of the way, i.e., as soon as there is room for pivoting of the platforms 32 back to the positions in which their supporting surfaces 113 are ready to receive components from the lifters 109, 110. A roll which has been provided with a pair of disc-shaped components can be removed from the positioning unit 117 in the direction of arrow V5 as soon as the member 41 of the respective section of the orientation changing unit 112 is moved out of the way, i.e., as soon as the lower member 41 of FIG. 10 cannot interfere with an axial movement of the roll on the carriers 18 and 19 in the direction of arrow V5. A fresh roll can be introduced into the positioning unit 117 by moving counter to the direction which is indicated by the arrow V5 or by moving in such direction but from the other side of the unit 117, namely from above as seen in FIG. 10. It is also possible to provide the apparatus with means for delivering fresh rolls **20, 20*a* etc. in a direction at right angles to the axes of the carriers 18 and 19; this ensures that a roll can be evacuated from the space above the carriers 18, 19 as soon as the fastening of a pair of disc-shaped or similar components is completed, i.e., as soon as the members 41 are retracted by the respective carriages 47. This ensures that two freshly delivered components are ready for movement toward the respective end faces of a roll on the carriers 18 and 19 as soon as the fresh roll has entered the positioning unit 117**.

The disc-shaped components can be assembled into stacks 2, and such stacks can be placed onto standard pallets 1, in the plant wherein the components **3, 3*a*, etc. are made. This simplifies the replenishment of depositories with fresh supplies of stacked components. Fork lift trucks or similar vehicles can be used to deliver fresh (loaded) pallets 1** to depositories wherein the supplies of components are depleted as well as to remove empty pallets from the respective depositories. This ensures that the supplies of components in the depositories are maintained at a desired level with a minimum of manual effort or with no manual effort at all. As mentioned above, it is preferred to maintain two empty depositories for advance delivery of components which are needed or which are about to be needed in order to avoid an interruption of operation of the improved apparatus. This, too, contributes to a higher output.

By way of example, the improved apparatus can store stacks of components including a pair of stacks with components having a diameter of 850 mm, two stacks of components having a diameter of 1500 mm, and one or more pairs of stacks of components having a diameter between 850 and 1500 mm. The height of each fresh stack 2 can be close to or can match 1800 mm. Of course, it is equally possible to manipulate components having diameters below 850 mm or even greater than 1500 mm. Furthermore, it is possible to manipulate components which have a polygonal rather than a truly circular outline.

Still further, it is possible to modify the conveyor, the depositories, the orientation changing unit and/or the positioning unit of the improved apparatus in a number of additional ways without departing from the spirit of the invention. For example, it is possible to employ pneumatic, hydraulic, electric and/or other prime movers. In addition, the fastener applying device 49 can be designed to apply staples of steel or another suitable material, and such fastener applying device can be designed and mounted to attach disc-shaped or similar components to marginal portions of the end faces of rolls in the positioning unit 17, 117, i.e., not necessarily to the cores or to the plugs in the cores of such rolls.

If the positioning unit 17 or 117 is equipped with means for draping convoluted webs of paper or the like into envelopes forming hollow cylinders around the outermost convolutions of the webs and extending beyond the axial ends of the convoluted webs, the unit 17 or 117 can be further equipped with means for folding the projecting portions of the envelopes against the end faces of the convoluted webs before the components **3, 3*a*** or other components are applied over the folded-over portions of the envelopes so that the thus applied components constitute the outer walls of the resulting finished envelopes each of which has a cylindrical portion surrounding the outermost convolution of the web and two end walls or panels constituted by a pair of disc-shaped components having a proper size to overlie the respective folded portions of the originally open-ended cylindrical envelope.

It is further possible to provide the orientation changing unit 12 or 112 with adjustable and/or exchangeable stops in order to further enhance the accuracy of centering of the components prior to application to the end faces of rolls in the positioning unit 17 or 117. For example, the stops 14, 15 or 114, 115 can be mounted for movement relative to the respective applicators 13A (stops 14, 15) or platforms 32 (stops 114, 115) between retracted or inoperative and extended or operative positions. It is also possible to provide the transporting means with one or more tracks (5 or 24, 26) which define a partly straight and a partly arcuate or a strictly arcuate path for the conveyor 4 or 104. The overhead track 26 for the conveyor 104 can be omitted if the lower track 24 is designed to adequately guide the conveyor 104 along a straight or an otherwise configurated path. It is also possible to omit the track 5 or the tracks 24, 26 and to provide optical guide means for the conveyor 4 or 104.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means, the depositories of said battery forming two rows which flank said path; and means for changing the orientation of components between said maintaining means and said depositories.

2. The apparatus of claim 1, wherein said path is substantially straight.

3. The apparatus of claim 1, wherein at least a portion of said path is arcuate.

4. The apparatus of claim 1, wherein each of said depositories includes a pallet for a stack of components.

5. The apparatus of claim 1 for storing and manipulating m different flat components, wherein said battery includes m+n depositories, n being a whole number including one.

6. The apparatus of claim 1, wherein said orientation changing means comprises a supporting surface for discrete components and stop means adjacent said surface, a component which is supplied to said surface by said conveyor means being movable along or with said surface against said stop means preparatory to movement against one end face of an object in said positioning unit.

7. The apparatus of claim 1, wherein said conveyor means includes means for simultaneously carrying two components including a first component taken from a depository in one of said rows and a second component taken from a depository in the other of said rows.

8. The apparatus of claim 6, wherein said stop means includes two mutually inclined substantially flat contact surfaces for a component on said supporting surface.

9. The apparatus of claim 6, wherein said orientation changing means further comprises means for changing the inclination of said supporting surface and said stop means between a substantially horizontal position and a substantially vertical position in which said stop means is located at a level below the component on said supporting surface.

10. The apparatus of claim 6, wherein said orientation changing means comprises means for applying components to the end faces of an object in said positioning unit.

11. The apparatus of claim 1, wherein said conveyor means includes at least one pneumatic lifter of components and elevator means for moving said at least one lifter up and down.

12. The apparatus of claim 11, wherein said conveyor means further includes at least one arm arranged to advance at a level above the depositories of said battery in response to movement of said conveyor means along said path, said lifter being provided on said at least one arm so that the lifter can pick up a component from a selected depository in response to downward movement under the action of said elevator means while said arm is disposed at a level above the selected depository.

13. The apparatus of claim 11, wherein said conveyor means comprises a plurality of lifters and means for adjusting at least one of said lifters with reference to said elevator means.

14. The apparatus of claim 10, wherein said supporting surface is provided on said applying means.

15. The apparatus of claim 10, wherein said supporting surface is movable to and from a substantially vertical position in which said supporting surface is substantially parallel to an end face of the object in said positioning unit, said applying means being movable between a first position for reception of components from said supporting surface and a second position adjacent the object in said positioning unit.

16. The apparatus of claim 15, further comprising means for moving said applying means between said first and second positions.

17. The apparatus of claim 16, wherein said moving means includes a lever pivotable about a predetermined axis and arranged to move the applying means along an arcuate path between said first and second positions.

18. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means, said guide means including a first and a second track for said conveyor means and one of said tracks being disposed at a level above the other of said tracks; and means for changing the orientation of components between said maintaining means and said depositories.

19. The apparatus of claim 8, wherein said other track includes means for movably supporting said conveyor means and said one track includes means for confining said conveyor means to movements along said path.

20. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery and conveyor means mounted for movement along said path to transport components from selected depositories of said battery toward said maintaining means, said guide means defining an overhead track for said conveyor means and said conveyor means being suspended on and being movable along said overhead track; and means for changing the orientation of components between said maintaining means and said depositories.

21. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means; and means for changing the orientation of components between said maintaining means and said depositories, said orientation changing means comprising a supporting surface for discrete components and stop means adjacent said surface, a component which is supplied to said surface by said conveyor means being movable along or with said surface against said stop means preparatory to movement against one end face of an object in said positioning unit, said orientation changing means further comprising at least one conveying device defining said supporting surface and being movable in a direction to advance a component on said supporting surface against said stop means.

22. The apparatus of claim 21, wherein said orientation changing means comprises a plurality of conveying devices each defining a portion of said supporting surface.

23. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components, each of said depositories comprising a pallet for a stack of components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means, said conveyor means including at least one pneumatic lifter of components and elevator means for moving said at least one lifter up and down; and means for changing the orientation of components between said maintaining means and said depositories.

24. Apparatus for storing and end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible, said maintaining means including two substantially horizontal carriers arranged to contact two spaced-apart portions of the peripheral surface of an object in said positioning unit; transporting means including guide means defining an elongated path extending from said maintaining means along the depositories of said battery, and conveyor means mounted for movement along said path to transport components from selected depositories of said battery toward said maintaining means; and means for changing the orientation of components between said maintaining means and said depositories, said orientation changing means comprising a supporting surface for discrete components and stop means adjacent said surface, a component which is supplied to said surface by said conveyor means being movable along or with said surface against said stop means preparatory to movement against one end face of an object in said positioning unit, said stop means being arranged to contact two spaced-apart portions of a component on said supporting surface.

25. The apparatus of claim 24, wherein the mutual spacing of regions of contact between said carriers and an object in said positioning unit equals or approximates the mutual spacing of regions of contact between said stop means and a component on aid supporting surface.

26. The apparatus of claim 24, wherein each of said carriers includes a cylindrical member.

27. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions hat the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means; and means for changing the orientation of components between said maintaining means and said depositories, said orientation changing means comprising a supporting surface for discrete components and stop means adjacent said surface, a component which is supplied by said surface by said conveyor means being movable along or with said surface against said stop means preparatory to movement against one end face of an object in said positioning unit, said stop means having two convex surfaces for the component on said supporting surface.

28. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means; and means for changing the orientation of components between said maintaining means and said depositories, said orientation changing means comprising means for supplying components to the end faces of an object in said positioning unit, a supporting surface for discrete components, said supporting surface being provided on said applying means and said orientation changing means further comprising stop means adjacent said surface, said stop means being movably mounted on said applying means and being retractable into said supporting surface, a component which is supplied to said surface by said conveyor means being movable along or with said surface against said stop means preparatory to movement against one end face of an object in said positioning unit.

29. Apparatus for storing and manipulating different flat components, particularly disc-shaped nd walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means; and means for changing the orientation of components between said maintaining means and said depositories, said orientation changing means comprising means for applying components to the end faces of an object in said positioning unit and a supporting surface for discrete components, said supporting surface being movable to and from a substantially vertical position in which said supporting surface is substantially parallel to an end face of the object in said positioning unit and said applying means being movable between a first position for reception of components from said supporting surface and a second position adjacent the object in said positioning unit, said orientation changing means further comprising stop means adjacent said surface and means for moving said applying means between said first and second positions, said moving means including a lever pivotable about a predetermined axis and arranged to move the applying means along an arcuate path between said first and second positions, said orientation changing means also comprising means for changing the level of said axis, a component which is supplied to said surface by said conveyor means being movable along or with said surface against said stop means preparatory to movement against one end face of an object in said positioning unit.

30. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means; and means for changing the orientation of components between said maintaining means and said depositories, said orientation changing means comprising means for applying components to the end faces of an object in said positioning unit and a supporting surface for discrete components, said supporting surface being movable to and from a substantially vertical position in which said supporting surface is substantially parallel to an end face of an object in said positioning unit, said applying means being movable between a first position for reception of components from said supporting surface and a second position adjacent the object in said positioning unit, said orientation changing means further comprising stop means adjacent said surface and means for moving said applying means between said first and second positions, said moving means including a lever pivotable about a predetermined axis and arranged to move the applying means along an arcuate path between said first and second positions, said orientation changing means further comprising means for advancing said lever in substantial parallelism with the axis of the object in said positioning unit, a component which is supplied to said surface by said conveyor means being movable along or with said surface against said stop means preparatory to movement against one end face of an object in said positioning unit.

31. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means; and means for changing the orientation of components between said maintaining means and said depositories, said orientation changing means comprising means for applying components to the end faces of an object in said positioning unit and including means for driving fasteners into objects in said positioning unit, a supporting surface for discrete components and stop means adjacent said surface, a component which is supplied to said surface by said conveyor means being movable along or with said surface against said stop means preparatory to movement against one end face of an object in said positioning unit.

32. The apparatus of claim 31, wherein said applying means has a substantially circular outline and said driving means is located substantially centrally of said applying means.

33. Apparatus for storing and manipulating different flat components, particularly disc-shaped end walls, of envelopes for substantially cylindrical objects of the type having a peripheral surface and two end faces flanking the peripheral surface, such as rolls of paper and the like, comprising a battery of depositories for different components; a positioning unit having means for maintaining discrete objects in such positions that the end faces of an object in said positioning unit are accessible; transporting means including guide means defining an elongated path extending from said maintaining means along the depositories of said battery, and conveyor means mounted for movement along said path to transport components from selected depositories of said battery toward said maintaining means; means for changing the orientation of components between said maintaining means and said depositories; signal generating means for monitoring the diameters of objects in said positioning unit; and means for operating said conveyor means and said orientation changing means in accordance with a predetermined program in response to signals from said monitoring means.

34. The apparatus of claim 33, wherein said operating means comprises a computer.

* * * * *